US008684235B2

(12) United States Patent
Inaba et al.

(10) Patent No.: US 8,684,235 B2
(45) Date of Patent: Apr. 1, 2014

(54) TRIGGER-TYPE LIQUID SPRAYER

(75) Inventors: Shinichi Inaba, Tokyo (JP); Takeshi Omi, Tokyo (JP); Tetsuya Kobayashi, Tokyo (JP); Takayuki Abe, Tokyo (JP); Masayuki Nakamura, Tokyo (JP); Hidesato Kizaki, Tokyo (JP)

(73) Assignees: Kao Corporation, Tokyo (JP); Yoshino Kogyosho Co., Ltd., Tokyo (JP)

( * ) Notice: Subject to any disclaimer, the term of this patent is extended or adjusted under 35 U.S.C. 154(b) by 181 days.

(21) Appl. No.: 12/026,906

(22) Filed: Feb. 6, 2008

(65) Prior Publication Data

US 2008/0191061 A1 Aug. 14, 2008

(30) Foreign Application Priority Data

| | | |
|---|---|---|
| Feb. 14, 2007 | (JP) | 2007-034069 |
| Feb. 14, 2007 | (JP) | 2007-034070 |
| Feb. 19, 2007 | (JP) | 2007-037343 |
| Feb. 19, 2007 | (JP) | 2007-037479 |
| Feb. 19, 2007 | (JP) | 2007-037481 |

(51) Int. Cl.
*B05B 11/00* (2006.01)

(52) U.S. Cl.
USPC ..... 222/153.13; 222/383.1; 222/384; 239/333; 239/581.1

(58) Field of Classification Search
USPC ..... 239/337, 533.1, 533.15, 581.1; 222/383.1, 384, 153.13; 251/114
See application file for complete search history.

(56) References Cited

U.S. PATENT DOCUMENTS

| | | | | |
|---|---|---|---|---|
| 2,791,358 | A * | 5/1957 | Gaertner | 222/553 |
| 4,516,695 | A | 5/1985 | Garneau | |
| 4,595,127 | A * | 6/1986 | Stoody | 222/135 |
| 6,006,950 | A * | 12/1999 | Watanabe et al. | 222/153.13 |
| 6,669,058 | B1 * | 12/2003 | Sweeton | 222/153.13 |
| 7,032,777 | B2 * | 4/2006 | Good et al. | 222/1 |
| 2005/0082311 | A1 * | 4/2005 | Good et al. | 222/1 |

FOREIGN PATENT DOCUMENTS

| | | |
|---|---|---|
| JP | 7-16051 | 4/1995 |
| JP | 10-146548 | 6/1998 |
| JP | 10-146550 | 6/1998 |
| JP | 2000-233145 | 8/2000 |

(Continued)

OTHER PUBLICATIONS

Office Action issued Oct. 11, 2011 in Japan Application No. 2007-034069 (With English Translation).

(Continued)

*Primary Examiner* — Jason Boeckmann
(74) *Attorney, Agent, or Firm* — Oblon, Spivak, McClelland, Maier & Neustadt, L.L.P.

(57) ABSTRACT

A trigger-type liquid sprayer of the present invention is provided with a liquid sprayer body 2 having a nozzle 21 and a trigger lever 22 and a shroud 3 covering the liquid sprayer body 2 and sprays a liquid from a spray hole 211 in the nozzle 21 by a pulling operation of the trigger lever 22. The nozzle 21 is rotatable with respect to the liquid sprayer body 2 and provided so as to open/close a flow passage for the liquid according to a rotational position of the nozzle 21 when an operation lever 24 mounted on the nozzle 21 is rotationally moved, and an abutment portion 31 for positioning the nozzle 21 at a position where the flow passage is opened through abutment of the operation lever 24 is provided at the shroud 3.

7 Claims, 8 Drawing Sheets

(56) References Cited

FOREIGN PATENT DOCUMENTS

| | | |
|---|---|---|
| JP | 2001-10653 | 1/2001 |
| JP | 3243743 | 1/2002 |
| JP | 2004-230326 | 8/2004 |
| JP | 2004-230347 | 8/2004 |
| JP | 2006-136803 | 6/2006 |
| JP | 2006-297219 | 11/2006 |

OTHER PUBLICATIONS

Office Action issued Oct. 11, 2011 in Japan Application No. 2007-037343 (With English Translation).
Chinese Office Action issued Oct. 21, 2011, in Patent Application No. 200810074118.3 (with English-language translation).
Combined Chinese Office Action and Search Report issued Aug. 24, 2012 in Chinese Patent Application No. 200810074118.3 (with English-language translation).

* cited by examiner

TRIGGER-TYPE LIQUID SPRAYER

BACKGROUND OF THE INVENTION

1. Field of the Invention

The present invention relates to a trigger-type liquid sprayer (hereinafter also referred to simply as "liquid sprayer") used by being attached to a container accommodating a liquid.

2. Description of Related Art

Various liquid sprayers provided with a liquid sprayer body having a nozzle, a spin element and a trigger lever and a shroud covering the liquid sprayer body and configured to spray a liquid from a spray hole of the nozzle through a pulling operation of the trigger lever have been proposed. A container provided with this type of liquid sprayer is widely used in recent years for containers containing hair styling spritz, air freshener and the like.

According to the art described in Japanese Patent Publication No. 2006-297219, the nozzle is positioned at a spraying position of a liquid by providing engagement projection portions engaged with each other which are provided between a nozzle and a spin element fitted therein, and operating by an operation plate rotating with the nozzle and engaging the engagement projection portions with each other.

However, with the above liquid sprayer, the nozzle is positioned at the spraying position of a liquid by rotating the operation plate and engaging the engagement projection portion formed on an inner face of the nozzle with the engagement projection portion on the spin element. Thus, there was a possibility that the engagement projection portions were chipped or broken by a rotary torque of the operation plate. Particularly, a fitting pressure is applied to the nozzle by fitting with other parts such as the spin element. The nozzle is also in contact with a contained liquid. Thus, environmental stress rupture may easily occur, and moreover, the rotary torque by the operation plate applied to the engagement projection portion may induce the environmental stress rupture. Also, since the engagement projection portions are engaged with each other inside the nozzle, there is a problem that the engaged state can not be easily checked from the outside.

Moreover, with this type of liquid sprayer, a piston is pushed into a cylinder by the pulling operation of a trigger lever so as to spray a liquid reserved in the cylinder from a spray hole, and thus it is necessary to exert a force in the horizontal direction with respect to the piston when the trigger lever is pulled. Therefore, in the conventional liquid sprayer, the rotation center of the trigger lever is separated from the nozzle and a distance between the rotation center and a point of application of force between the trigger lever and the piston is expanded so that a trajectory of the point of application is brought close to the horizontal and the force works onto the piston substantially horizontally.

On the other hand, as in a liquid sprayer described in Patent No. JP3243743, regulating means may be provided for preventing inadvertent spraying of contents due to erroneous operation of the trigger lever, and the above configuration was not preferable when this regulating means was to be added. Moreover, with this type of liquid sprayer, there has been a demand for size reduction so that the sprayer can be easily operated even by one hand.

In a liquid sprayer described in Japanese Patent Publication No. 2006-136803, a flow passage is formed by providing a groove communicating with each other at a fitting portion between a cylindrical portion extending to a side opposite to the liquid spraying direction with respect to the nozzle spray hole and a spin element so as to spray the liquid from the spray hole through the flow passage.

In this type of liquid sprayer, if a groove is provided at a fitting portion between a nozzle and a spin element, a sectional shape of the groove portion becomes uneven (thin). Thus, as with the liquid sprayer described in Japanese Patent Publication No. 2006-136803, it was easily damaged if a flow passage for the liquid formed at a specific rotating position by rotating the nozzle. Particularly, a fitting pressure is applied to the nozzle by being fitted with other parts such as the spin element and also in contact with a contained liquid, and thus, environmental stress rupture may easily occur and may induce the environmental stress rupture.

In a liquid sprayer described in Japanese Utility Model Publication No. 7-16051, a cylindrical body (spray cylinder) forming a spray path of contained liquid is supported by a main body portion of a body in a cantilever state and a spin element for applying a turning force to the contained liquid relating to spraying is usually attached at its tip end. However, a repulsion force (biasing force) of an elastic member biasing a piston toward the side of a trigger lever was often seen to act in a direction to push up the cylindrical body from the trigger lever through the spin element and cause flexural deformation on the cylindrical body.

In this case, since an installation position of the trigger lever is displaced upward, the piston is also lifted up at its front end portion, and though the piston should have been operated with the same shaft core as the shaft core of the cylinder when the pulling operation of the trigger lever is performed, the piston is diagonally pushed into the cylinder, which impairs reciprocation of the piston and prevents maintenance of a desired spraying form. Moreover, it is worrisome that sealing performance between the piston and the cylinder is lowered and a liquid leaks from between members.

Moreover, in this type of liquid sprayer, a method of fixing and holding the sprayer at a spout portion of a container by screwing through an intake (a base portion of the intake) at a lower end of a body is generally employed, and the sprayer is fixed and held by sandwiching the intake base portion between the spout portion of the container and the body at the lower end of the body. Thus, the lower end of the body is set with such a diameter that can be inserted through an opening of a cap, while its inside has to be thinned for connection with the base of the intake.

The thinning at the lower end portion of the body may cause flexural deformation to narrow a gap between the body front side (side where a spray nozzle is located) and a cap when a large impact is applied to the liquid sprayer due to inadvertent drop or the like and may damage the intake incorporated in the body, particularly the base portion of the intake or the cap screwed into the spout portion of the container through the intake, and it is also worrisome that the body may be easily removed from the intake.

SUMMARY OF THE INVENTION

The present invention provides a trigger-type liquid sprayer provided with a liquid sprayer body having a nozzle and a trigger lever and a shroud covering the liquid sprayer body, in which a liquid is sprayed from a spray hole of the nozzle by a pulling operation of the trigger lever, wherein the nozzle is rotatable with respect to the liquid sprayer body and provided so that a flow passage of the liquid is opened/closed according to a rotational position of the nozzle when an operation lever mounted on the nozzle is rotationally moved, and the shroud is provided with an abutment portion for positioning the nozzle at a position where the flow passage is opened by having the operation lever abutted.

DETAILED DESCRIPTION OF THE INVENTION

The present invention will be described with reference to the drawings based on preferred embodiments.

Figure 1A:
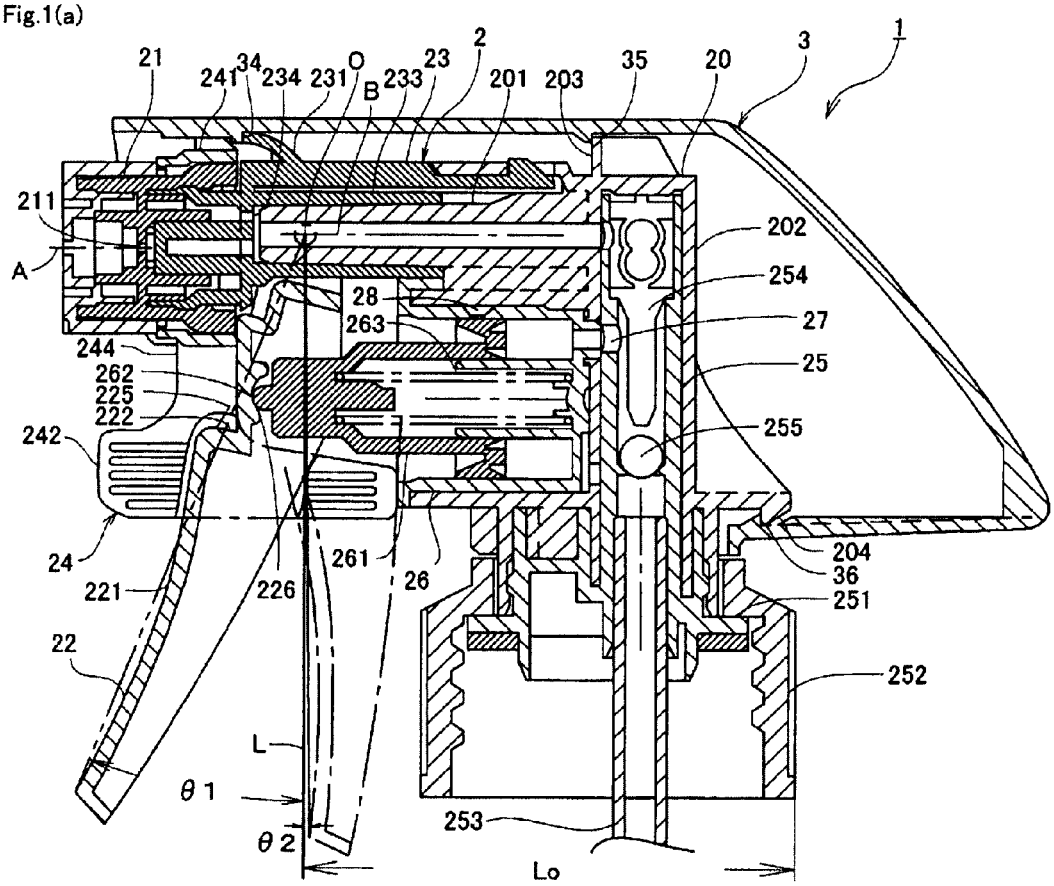
FIGS. 1(*a*) to 1(*c*) are views illustrating a first embodiment of a trigger-type liquid sprayer of the present invention, in which FIG. 1(*a*) is a partially cutaway sectional side view, FIG. 1(*b*) is a partially enlarged view, FIG. 1(*c*) is a sectional view of a fitting portion between a cylindrical portion of a nozzle and a fitting portion of a spin element at a tip end of the fitting portion of the spin element in FIG. 1(*b*).
Figure 1B:
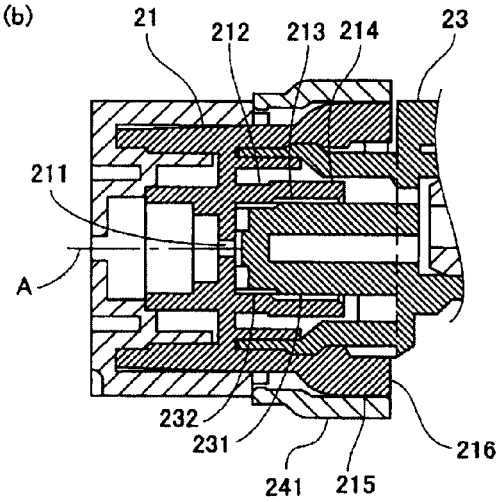
Figure 1C:
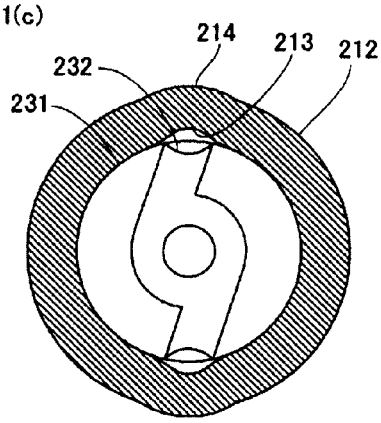
Figure 2C:
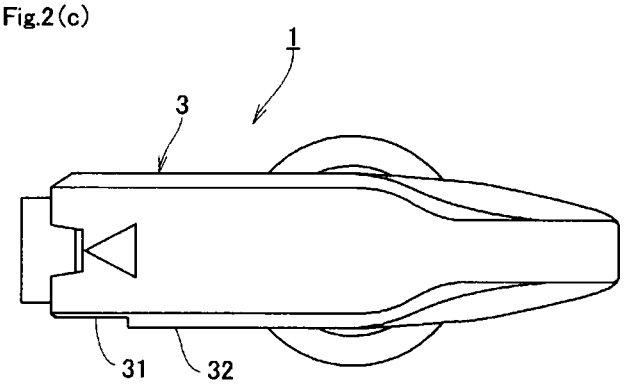
FIGS. 2(*a*) to 2(*c*) are views illustrating an appearance of the trigger-type liquid sprayer of the same embodiment, in which FIG. 2(*a*) is a front view, FIG. 2(*b*) is a side view, and FIG. 2(*c*) is a plan view of FIG. 2(*b*).
Figure 2A:
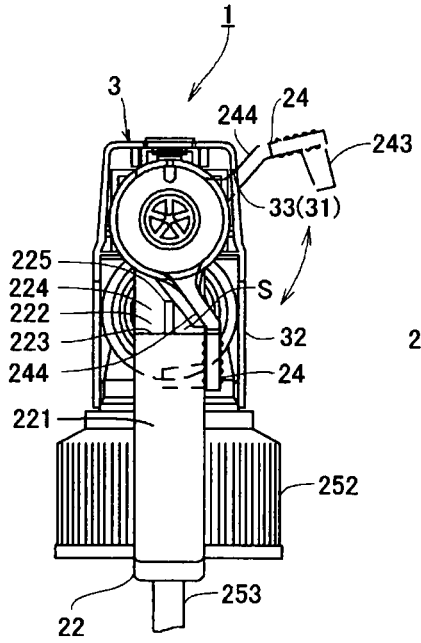
Figure 2B:
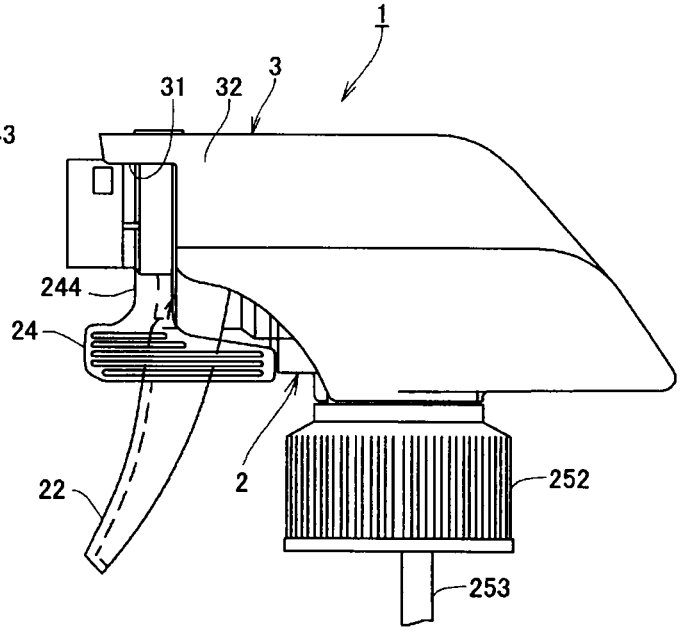

FIG. 1 and FIG. 2 are schematic diagrams illustrating a first embodiment of a liquid sprayer of the present invention.

A liquid sprayer 1 of the present embodiment is provided with a liquid sprayer body 2 having a nozzle 21, a spin element 23, and a trigger lever 22 and a shroud 3 covering the liquid sprayer body 2.

The liquid sprayer body 2 is configured with parts forming a flow passage for spraying a liquid from a spray hole 211 of the nozzle 21 through the spin element 23 by a pulling operation of the trigger lever 22, as will be described below, mounted on a body frame 20 having a lateral tube portion 201 and a vertical tube portion 202 with insides communicating with each other.

The spin element 23 is mounted in a liquid spray direction (front) in the lateral tube portion 201 in the body frame 20, and the nozzle 21 is mounted in front of the spin element 23 rotatably with respect to the liquid sprayer body 2 with an axis A passing through its spray hole 211 as its center axis. In a cylindrical portion 212 extended and opened to the side (rear) opposite to the spray direction with respect to the spray hole 211 in the nozzle 21, a cylindrical portion 231 of the spin element 23 is fitted. On an inner circumferential face of the cylindrical portion 212 in the nozzle 21 and an outer circumferential face of the cylindrical portion 231 in the spin element 23, grooves 213, 232 are provided, respectively, so that when the nozzle 21 is rotated around the axis A of the spray hole 211 and the grooves 213, 232 overlap each other, a flow passage for the liquid is formed. On the outer circumference of the cylindrical portion 212, a bulging portion 214 with a curved surface is provided in correspondence with a section of the groove 232. A curvature of the surface of the bulging portion 214 is set to the same curvature as that of the groove 213, and the cylindrical portion 212 has a uniform thickness at the groove 213 portion.

On the nozzle 21, an operation lever 24 for rotating the nozzle 21 around the axis A of the spray hole 211 is mounted. In the present embodiment, by fitting a cylindrical portion 241 of the operation lever 24 in the outer cylindrical portion 215 extended to the side (rear) opposite to the spraying direction of the nozzle 21, the operation lever 24 is mounted on the nozzle 21. In the present embodiment, the nozzle 21 is provided so as to open/close the liquid flow passage according to a rotational position of the nozzle 21 when the operation lever 24 is rotationally moved around the axis A in the above configuration.

The trigger lever 22 is mounted on the spin element 23 and/or the body frame 20 so that the lever can oscillate around a rotation center O on the side face portion of the body frame 20.

In the liquid sprayer 1, the surface of the trigger lever 22 is partially recessed and a space S (See FIG. 2) is provided. The space S is provided in a configuration according to the form of the trigger lever 22. In the present embodiment, the space S is provided by retreating a front face portion 221 of the trigger lever 22 toward the rotation center O side to form a stepped portion 222. By this configuration, in the liquid sprayer 1, when the operation lever 24 is rotationally moved around the axis A to close the flow passage by the nozzle 21, a part of the operation lever 24 is accommodated in the space S. In the present embodiment, a part of a rod portion 244 in the operation lever 24 is provided to be accommodated in the space S. By providing such a space S (stepped portion 222), a front and rear position (horizontal position) of the rotation center O in the trigger lever 22 can be brought close to a rear end portion 216 of the nozzle 21 so as to ensure clearance (predetermined distance) between the front face portion 221 of the trigger lever 22 and a cap 252 and to ensure an oscillating angle of the trigger lever 22 in front of a reference line L suspended from the rotation center O, as will be described later, and the lateral tube portion 201 is made as short as possible to reduce the size of the liquid sprayer 1. A gap may be provided between the rear end portion of the rod portion 244 and a depth face portion 224 of the stepped portion 222, or they may be brought into contact.

A height position of the rotation center O of the trigger lever 22 is preferably in a range accommodated in a cylindrical fitting portion 233 of the spin element 23 fitted in the lateral tube portion 201 of the body frame 20 and particularly a height of the shaft center of the fitting portion 233. The position of the front and rear direction (horizontal direction) of the rotation center O of the trigger lever 22 is preferably provided close to the rear end portion 216 of the nozzle 21 so that rotation of the nozzle 21 is not prevented. Specifically, it is preferably provided within a half, more preferably a third of the length of the fitting portion 233 from a projecting base portion 234 of the fitting portion 233 and close to the rear end portion 216 of the nozzle 21 so that the rotation of the nozzle 21 is not prevented. Considering mounting of the trigger lever 22, a lower limit is 3 mm from the projecting base portion 234. The length of the fitting portion 233 is set at from 13 to 25 mm, considering fitting strength, mounting of the trigger lever and the like. The rear end portion 216 of the nozzle 21 is preferably projected to the same extent as the tip end of the trigger lever 22 in the front and rear direction of the nozzle 21 or to such an extent that the nozzle 21 is slightly extended forward from the viewpoint of compactification. A horizontal distance Lo from the rotation center O of the trigger lever 22 to the rear of the cap 252 is preferably 35 to 50 mm, considering a sufficient pulling operation with one hand. In the present embodiment, it is set at 47 mm.

An oscillating angle of the trigger lever 22 is an angle when the lever is pulled to the front most from a state before pulling the trigger lever 22 and is represented by a swing angle of a virtual line connecting the tip end of the trigger lever 22 and the rotation center O with respect to a reference line L suspended from the rotation center O (hereinafter, suppose that the front swing angle of the reference line L is θ1 and a rear swing angle of the reference angle L is θ2. However, the front swing angle θ1 is positive in the front of the reference line and the rear swing angle is positive in the rear of the reference line.). For this oscillation angle, it is preferable that the swing angle θ2 in the rear of the reference line L is made small (the end position of the pulling operation is an approximately suspended position of the rotation center O) to create a pushing-in amount of the piston in the horizontal direction as much as possible by the front swing angle θ1 of the reference line L, considering compactification of the liquid sprayer 1, a distance between the trigger lever 22 and the cap 252, and ease in the pulling operation. The front swing angle θ1 is preferably 10 to 30 degrees and more preferably 15 to 20 degrees. The rear swing angle θ2 is preferably −10 to 10 degrees, more preferably −5 to 5 degrees and a totaled swing angle is preferably 10 to 25 degrees. In the present embodiment, the front swing angle θ1 is 19.8 degrees and the rear swing angle θ2 is 2.2 degrees. The trigger lever 22 is in a curved shape projecting rearward, and since the tip end of the trigger lever 22 projected forward is further projected forward by the stepped portion 222, the tip end of the trigger lever 22 can be positioned in front of the reference line L even when being pulled to the front most, while pushing-in of a piston 261 in the horizontal direction (in this case, the rear swing angle θ2 becomes negative) is enabled.

At the stepped portion 222 of the trigger lever 22, a reinforcing rib 225 is provided continuing to its base face portion 223 and a depth face portion 224 rising from the base face portion 223. The reinforcing rib 225 is provided so as not to prevent accommodation of a part of the operation lever 24 by the stepped portion 222. In the present embodiment, it is provided substantially at the center position in the width direction of the trigger lever 22 so as not to prevent accommodation of the rod portion 244. On the back face of the depth face portion 224 of the stepped portion 222 or preferably on the back face of the trigger lever 22 corresponding to the reinforcing rib 225, a recess face portion 226 having a curved face to be brought into contact with a projection portion 262 at the tip end of the piston 261, which will be described later, and to become a point application of the piston 261 is provided. The recess face portion 226 is preferably provided so that a trajectory of the point of application between the recess face portion 226 and the projection portion 262 of the piston 261 draws a fan arc around the rotation center O and is preferably provided so as to form a line-symmetric fan arc with respect to the reference line L. An angle of the fan in this case is set according to a horizontal traveling distance of the piston 261. Since the stepped portion 222 is provided, a region at the tip end side of the trigger lever 22 is located farther from the reference line L, and pushing-in of the piston 261 in the horizontal direction is enabled on the back side of the stepped portion 222, while the horizontal distance Lo is ensured.

At a knob piece portion 242 at the tip end portion of the operation lever 24, a projection portion 243 to prohibit the pulling operation of the trigger lever 22 is provided. When the operation lever 24 is rotated to a position close to the trigger lever 22, preferably to a position in contact and the operation lever 24 is pulled, the pulling direction side of the trigger lever 22 is brought into contact with the projection portion 243 so as to prohibit oscillation of the trigger lever 22. In the present embodiment, the rod portion 244 in the operation lever 24 is provided to stop oscillation from the side opposite to the pulling direction of the trigger lever 22. That is, the operation lever 24 also functions as a stopper for prohibiting the pulling operation (oscillation) of the trigger lever 22 from both sides of the oscillation direction and prevents improper spraying of the contained liquid by an inadvertent pulling operation (oscillation) of the trigger lever 22.

Since in the operation lever 24, the rod portion 244 is provided so as to be accommodated in the stepped portion 222 of the trigger lever 22, in addition to prohibition of the rotation by the projection portion 243, the trigger lever 22 is protected by the rod portion 244 from front, and removal of the trigger lever 22 from the liquid sprayer body can be also prevented when a force in a direction opposite to the pulling operation is applied to the trigger lever 22. In the present embodiment, a rear end face of the rod portion 244 of the operation lever 24 is provided flush with the rear end face 216 of the nozzle 21. Thus, a force other than that in the rotating direction is hardly applied when the operation lever 24 is rotated to rotate the nozzle 21, which enables smooth rotation of the nozzle 21.

On a lower part of the vertical tube portion 202 in the body frame 20, a pipe body 25 for liquid passing is mounted. At a lower part of the pipe body 25 for liquid passing, a flange portion 251 is provided, and the cap 252 is supported by the flange portion 251 to attach the liquid sprayer 1 to a container, not shown. The suction pipe 253 is inserted in the pipe body 25 for liquid passing from the lower end portion. Moreover, two upper and lower check valves 254, 255 are arranged inside the pipe body 25 for liquid passing.

At a part located at a front portion of the vertical tube portion 202 in the body frame 20 (on the side of the trigger lever 22) and located below the lateral tube portion 201, a cylinder 26 is mounted substantially horizontally. Inside the cylinder 26, the piston 261 that slides in the cylinder 26 by the pulling operation of the trigger lever 22 is arranged through an elastic member (spring in the present embodiment) 263. Inside of the cylinder 26 and the inside of the pipe body 25 for liquid passing communicate with each other through a communication path 27 penetrating a wall face portion of the cylinder 26 and the pipe body 25 for liquid passing. On a side face portion of the cylinder 26, an air inlet 28 for introducing air from the outside into the container is provided. This air inlet 28 communicates with an intake path (not shown) leading into the container.

At the shroud 3, an abutment portion 31 is provided for positioning the nozzle 21 at a position where the flow passage of the liquid is opened by having the operation lever 24 abutted. In the liquid sprayer 1 in the present embodiment, the end face of a notch portion 33 provided on a left side face portion 32 is made as the abutment portion on one of the side face portions in the front part of the shroud 3 (on the side of liquid spraying direction).

Engagement projection portions 34 to 36 are provided on an inner face of the shroud 3, and the shroud 3 is mounted so as to cover the outer side of the liquid sprayer body 2 by the engagement of these engagement projection portions with the engagement convex face portions 203, 204 provided on the frame 20 and the engagement projection portion 231 provided on the spin element 23.

In the liquid sprayer 1 in the present embodiment, the nozzle 21 is positioned only by abutment between the rod portion 244 in the operation lever 24 and the abutment portion 31 in the shroud 3. Thus, there is no conventional engagement projection portion provided between the nozzle 21 and the spin element 23, and the size of the container may be reduced.

When liquid is to be sprayed by the liquid sprayer 1, first, the cap 252 is screwed with a spout portion of the container (not shown) containing the liquid so as to attach the liquid sprayer 1 to the container. Then, the operation lever 24 is rotated to a position of a virtual line in FIG. 2(*a*), the regulation of the trigger lever 22 by the projection portion 243 and the rod portion 244 of the operation lever 24 is released, and the nozzle 21 is rotated around the axis A. Then, the rod 244 is abutted to the abutment portion 31 of the shroud 3, and the groove 213 of the nozzle 21 is made to communicate with the groove 232 of the spin element 23 so as to open the flow passage for the liquid. Then, by repeating the pulling operation of the trigger lever 22 against the elastic force of the spring 263 (elastic member), the piston 261 is slid and pushed into the cylinder 26. By this operation, the inside of the vertical tube portion 202 is pressurized, the check valve 254 is opened, and the liquid press-fed through the lateral tube portion 201 is sprayed from the spray hole 211 in the nozzle 21 through the grooves 232, 213 between the spin element 23 and the nozzle 21. When the pulling operation of the trigger lever 22 is released, the piston 261 returns to the original position by the elastic force of the spring 263, the check valve 255 is opened by a negative pressure in the vertical tube portion 202 and the contained liquid is sucked through a suction pipe 253, and air is introduced into the container from outside through the air inlet 28.

With the liquid sprayer 1 in the present embodiment, the nozzle 21 is positioned only by abutment between the rod portion 244 in the operation lever 24 and the abutment portion 31 in the shroud 3, and damage on parts caused by positioning of the nozzle through the rotating operation of the operation lever 24 as before or particularly damage on the parts caused by environmental stress rupture can be prevented. Also, the position of the nozzle 1 can be easily checked by visually checking if the operation lever 24 is abutted to the abutment portion 31 of the shroud and an abutment feeling exerted on fingers.

In addition, since the liquid sprayer 1 in the present embodiment is provided to accommodate a part of the operation lever 24 in the stepped portion 222 provided on the front face portion of the trigger lever 22, the trigger lever 22 and the rod portion 244 of the operation lever 24 that rotates the nozzle 21 may be crossed, so that a sufficient pulling operation of the trigger lever 22 and compactification of the liquid sprayer 1 may be achieved, and an improper spraying due to prohibition of the pulling operation of the trigger lever 22 may be prevented. Also, the trigger lever 22 is protected from the front; thus the liquid sprayer 1 is easily handled. The nozzle 21 is positioned only by abutment between the rod portion 244 in the operation lever 24 and the abutment portion 31 in the shroud 3, dispensing with providing an engagement projection portion in the nozzle 21 or the spin element, and thus size reduction may be achieved even further.

In the liquid sprayer 1 in the present embodiment, since the bulging portion 214 is provided at the cylindrical portion 212 of the nozzle at the fitting portion between the nozzle 21 and the spin element 23, damage on the fitting portion caused by the operation of the operation lever 24 can be restricted.

Next, a second embodiment of the present invention will be described with reference to FIGS. 3 to 6.

The trigger-type liquid sprayer according to the present embodiment is a trigger-type liquid sprayer provided with a spray nozzle continuing to a spin element, a body incorporating a pump, and an trigger lever oscillatably supported by the spin element through a pivotal support shaft for driving the pump and spraying contained liquid by a pulling operation, in which the body has a lateral cylindrical body to which the spin element is inserted and connected and forming a spray path of the contained liquid inside and a vertical passage communicating with the spray path of this cylindrical body; and at a main portion of the body, a frame extending along the cylindrical body is provided for guiding insertion connection of the spin element and regulating movement of the spin element in contact at least with an upper face wall of the spin element in the connected attitude.

Figure 3:
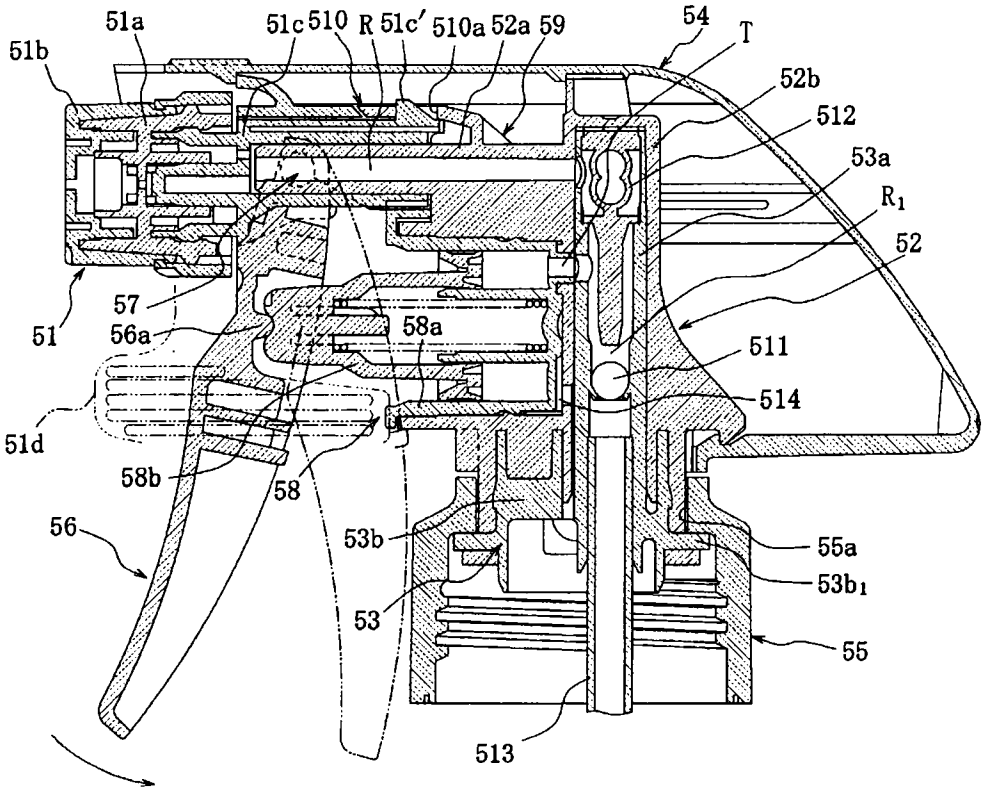
FIG. 3 is a sectional view illustrating a second embodiment of a trigger liquid sprayer according to the present invention.
Figure 4A:
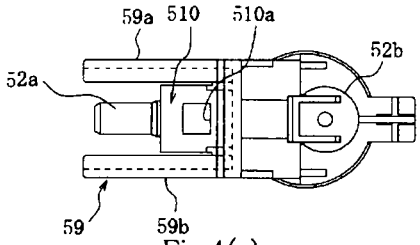
FIGS. 4(*a*) to 4(*e*) are views illustrating a plan, front, side, back and bottom of the body of the trigger-type liquid sprayer shown in FIG. 3.
Figure 4B:
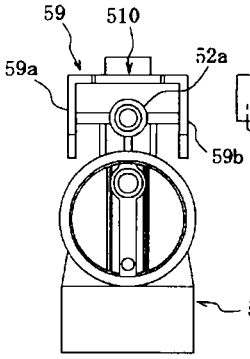
Figure 4C:
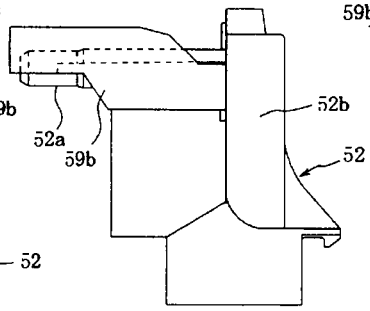
Figure 4D:
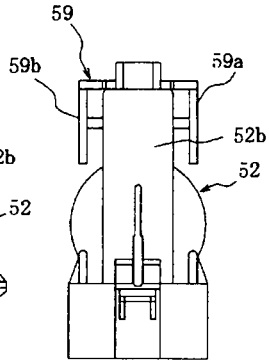
Figure 4E:
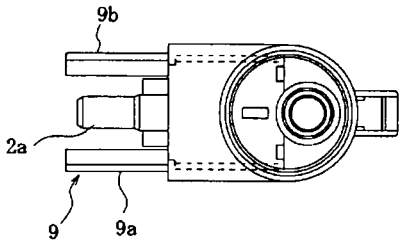
Figure 5A:
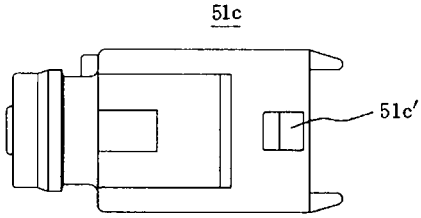
FIGS. 5(*a*) to 5(*e*) are views illustrating a plan, front, side, back and bottom of the spin element of the trigger-type liquid sprayer shown in FIG. 3.
Figure 5B:
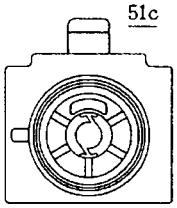
Figure 5C:
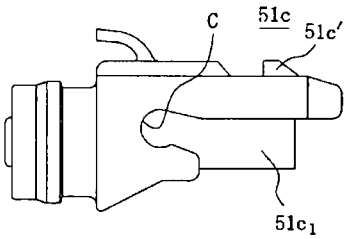
Figure 5D:
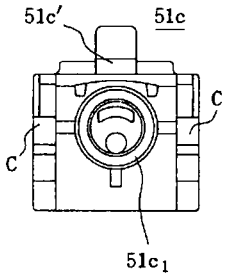
Figure 5E:
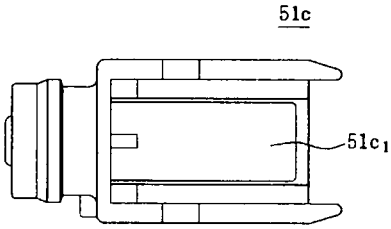
Figure 6:
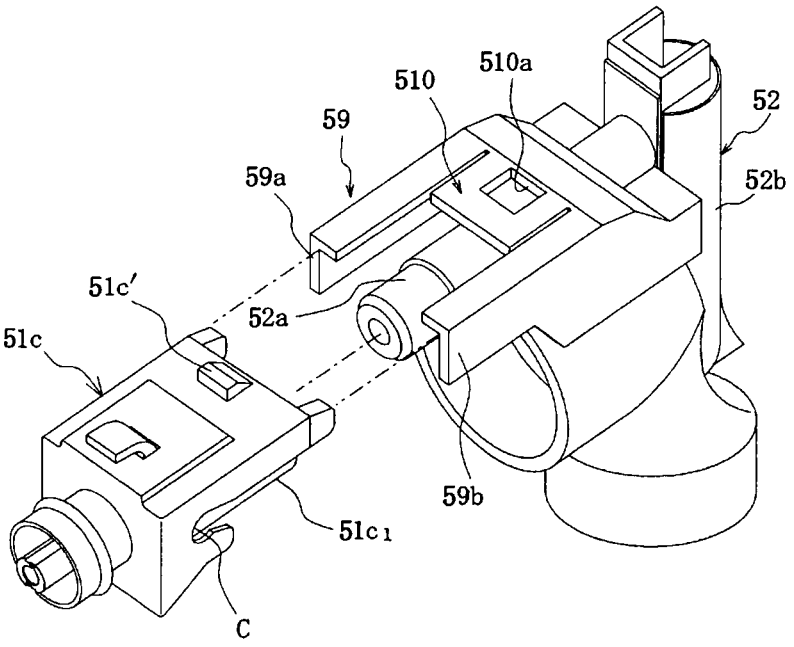
FIG. 6 is an appearance perspective view of the body and the spin element.

Reference numeral 51 in FIG. 3 is a spray nozzle. This nozzle 51 includes a nozzle body 51*a*, a nozzle cover 51*b*, and a spin element 51*c* connected to the rear end of the nozzle body 51*a* for applying a turning force to contained liquid to be sprayed. On a rear outer circumferential wall of the nozzle body 51*a*, an operation lever 51*d* rotated in synchronization with the rotation of the sprayer nozzle 51*a* is arranged, and a projection portion (not shown) is provided for preventing oscillation of a trigger lever located on a rear face of the trigger lever (which will be described later) and a front end face of a cylinder of a pump (which will be described later) in a closed state where the contained liquid can not be sprayed by the spray nozzle 51.

Reference numeral 52 is a body provided with the pump inside. The body 52 has a laterally cylindrical body (spraying cylinder) 52*a* connected by insertion at the rear end of the spin element 51*c* and forming a spraying path R of the contained liquid inside and a body portion 52*b* integrally provided with the cylindrical body 52*a*, and in the body portion 52*b*, a vertical passage $R_1$ continuing to the spraying path R of the cylindrical body 52*a* is formed.

Reference numeral 53 is an intake to be combined with the body portion 52*b*. This intake 53 includes a cylindrical body 53*a* fitted inside the passage $R_1$ of the body portion 52*b* and a base 53*b* integrated with the cylindrical body 53*a* and fitted at the lower end of the body portion 52*b*.

Reference numeral 54 is a cover covering the body 52 together with the spray nozzle 51, and reference numeral 55 is a cap which can screw the liquid sprayer at the spout portion of the container. The cap 55 has an opening 55*a* on the top face so that the lower end of the body portion 52*b* of the body 52 is inserted with the intake 53 through the opening 55*a* and sandwiched at the spout portion of the container through a flange 53*b*, provided integrally at the base 53*b* of the intake 53.

Reference numeral 56 is a trigger lever. The trigger lever 56 is oscillatably supported by the body 52 or the spin element 51*c* through a pivotal support shaft 57 (a notch portion C is provided on both side walls of the spin element 51*c* (See FIG. 5(*c*)) and the pivotal support shaft 57 is projected from the inside for support), and the contained liquid in the container is sprayed through the spray nozzle 51 by driving the pump through oscillation of the pivotal support shaft 57 at its fulcrum.

Reference numeral 58 is a pump. The pump 58 has a cylinder 58*a* having a passage T continuing to the passage $R_1$ of the body portion 52*b* in the body 52 and a piston 58*b* elastically supported slidably in the cylinder 58*a* through a coil spring and having a head linked with a projection 56*a* in the trigger lever 56.

Reference numeral 59 is a frame provided integrally at the body portion 52*b* in the body 52 in a cantilever support form. This frame 59 is, as its appearance illustrated in FIG. 6 to be easily understood, provided with angles 59*a*, 59*b* forming an inverted L-shaped section arranged in parallel with an interval on both sides of the cylindrical body 52*a*.

Reference numeral 510 is a tongue piece (See FIGS. 4, 6) capable of elastic displacement and integrally provided between the angles 59*a*, 59*b* of the frame 59. At this tongue piece 510, an opening 510*a* is formed so as to hold the spin element 51*c* at the tip end portion of the cylindrical body 52*a* by being fitted with a projection 51*c*' of the spin element 51*c*.

Reference numeral 511 is a check valve arranged in the passage $R_1$ of the body portion 52*b* and opened only at suctioning of the contained liquid, reference numeral 512 is also a valve body arranged in the passage $R_1$ of the body 52*b* and opened only at pressurization/compression of the contained liquid, reference numeral 513 is a suction tube fitted and held in the opening of the intake 53 for suctioning the contained liquid in the container, and reference numeral 514 is an outside-air introduction path opened by the pulling operation of the trigger lever 56 for introducing outside air into the container (the outside air is introduced through a hole for releasing negative pressure formed on an outer wall of the cylinder 58*a* and a gap (not shown) provided between the outer wall of the cylinder 58*a* and the peripheral wall of the body portion 52*b* fitted therewith).

With the spin element 51*c*, by inserting an opening portion of its pipe body 51*c*, (See FIGS. 5, 6) into the tip end portion of the cylindrical body 52*a*, they can be connected to each other, and at that time, a part of the upper face wall of the spin element 51*c* and a portion (corner portion) of a side face wall continuing to that are brought into contact with the inner wall faces of the angles 59*a*, 59*b*, and connection is achieved with the contact state maintained.

In the incorporation completed state (See FIG. 3) where the projection 51*c*' of the spin element 51*c* is fitted with the opening 510*a* of the tongue piece 510, the angles 59*a*, 59*b* are still in contact with the corner portion of the spin element 51*c*, and even if a force to displace the spin element 51*c* upward acts, for example, the angles 59*a*, 59*b* receive the force, and the spin element 51*c* will not move. Thus, the cylindrical body 52*a* continuing to that is not subjected to flexural deformation (distortion). Lifting-up of the trigger lever 56 and the front end portion of the piston 58*b* is also avoided, and nonconformity that the piston 58*b* is pushed diagonally is not caused.

The frame 59 provided with the angles 59*a*, 59*b* forming an inverted L-shaped section regulating upward movement of the spin element 51*c* is used as an example, but a peripheral wall forming a rectangular section or a circular section may be provided surrounding the cylindrical body 52*a* so that the spin element 51*c* is inserted inside the peripheral wall, and in this case, not only the upward movement of the spin element 51*c* but downward or right and left movement can be also regulated.

According to the present invention, since the frame extending along the shaft core of the cylindrical body is provided at the body portion of the body and is brought into contact at least with the upper face wall of the spin element to regulate the movement, the cylindrical body is hardly subjected to flexural deformation. Also, since the force to lift the trigger lever and the piston front end portion does not act, the piston is not pushed into the cylinder in the diagonal state.

According to the present invention, the trigger-type liquid sprayer can not only surely prevent flexural deformation (distortion) of the cylindrical body (spray cylinder) caused by a repulsion force of the elastic member (spring in the present embodiment) that supports the trigger lever 56, but also effectively avoid diagonal pushing of the piston derived from the flexural deformation.

Next, a third embodiment of the present invention will be described with reference to FIGS. 7 and 8. The portions in the third embodiment common to those in the second embodiment are given the same reference numerals. Thus, the descriptions in the second embodiment are applied as appropriate to the portions without particular description.

The trigger-type liquid sprayer according to the present embodiment is a trigger-type liquid sprayer having a sprayer body provided with a body having a spray nozzle at a tip end portion and incorporating a pump and a cap for fixing and holding the body at a spout portion of a container through an intake base, and an trigger lever oscillatably supported by the sprayer body through a pivotal support shaft and driving the pump and spraying a contained liquid inside the container for spraying through the spray nozzle by its pulling operation, in which the body has a lateral cylindrical body continuing to the spray nozzle and forming a spray path of the contained liquid and a vertical path continuing to the spray path of the cylindrical body and including a main body linked with the intake base at its lower end; and a reinforcing member is arranged at a position between the lower end of the main body and an opening end edge of the cap for relaxing an impact force applied thereto. The reinforcing member may be composed of at least one vertical rib.

Figure 7:
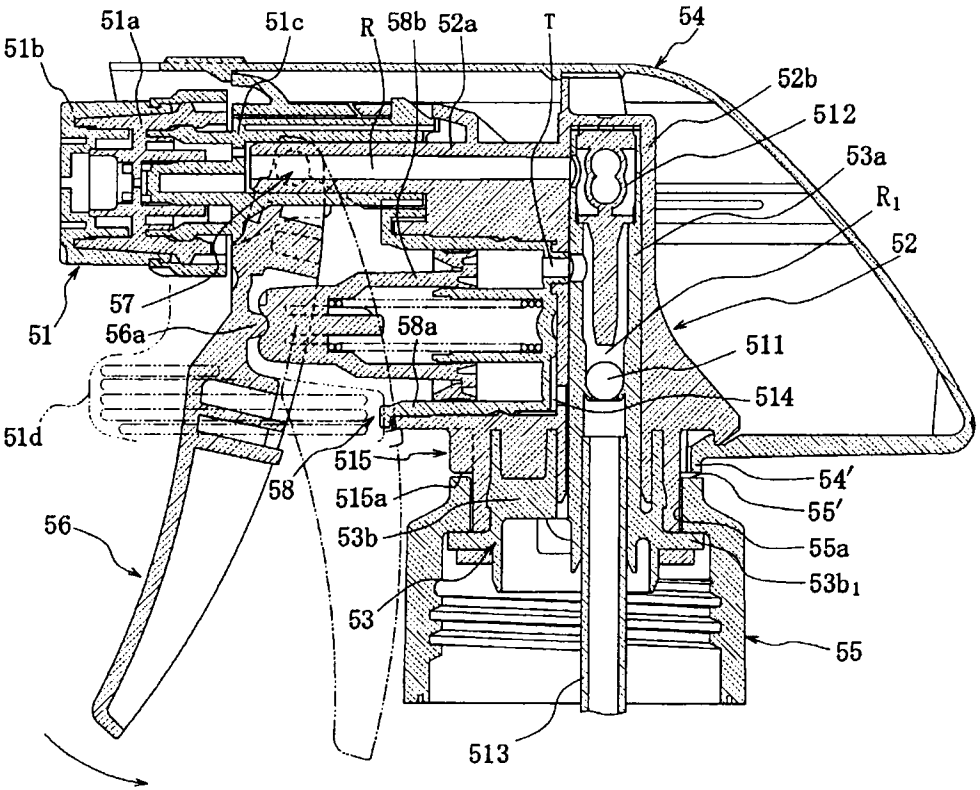
FIG. 7 is a sectional view illustrating a third embodiment of a trigger-type liquid sprayer according to the present invention.

In more detail, the trigger-type liquid sprayer in the present embodiment is provided with the spray nozzle and the body, and reference numeral 51 in FIG. 7 is a spray nozzle. The spray nozzle 51 includes the nozzle body 51*a*, the nozzle cover 51*b*, and the spin element 51*c* connected to the rear end of the nozzle body 51*a* for applying a turning force to a contained liquid related to spraying. On a rear outer circumferential wall of the nozzle body 51*a*, the operation lever 51*d* rotated in synchronization with the rotation of the nozzle body 51*a* is arranged, and a convex face portion (not shown) is provided for preventing oscillation of a trigger lever on a rear face of the trigger lever (which will be described later) and a front end face of a cylinder of a pump (which will be described later) in a closed state where the contained liquid can not be sprayed by the spray nozzle 51.

Reference numeral 515 is a reinforcing member integrally provided at the lower end of a cylindrical portion of the body portion 52*b*. To the reinforcing member 515, a vertical rib can be applied, and its lower end portion 515*a* extends with an extremely small gap toward an opening end edge 55' of the cap 55 so that the lower edge portion 515*a* of the reinforcing member 515 is brought into contact with the opening end edge 55' of the cap 55 to absorb/relax an external force when the external force (impact caused by drop or the like) is applied from above the sprayer, for example, by which damage at the intake 53 and a boundary portion between the body 52 and the cap 55 of the liquid sprayer is avoided. The reinforcing member 515 is provided at least below the cylinder 58*a* and is preferably provided also at a position opposite to that.

Figure 8:
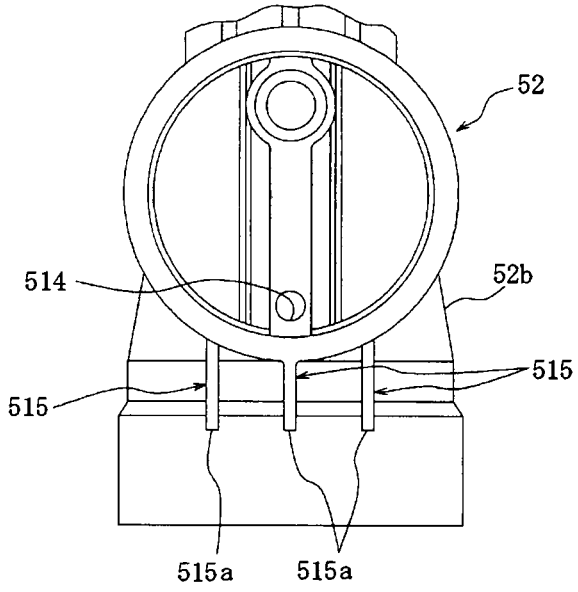
FIG. 8 is a view illustrating a front of the body portion of the trigger-type liquid sprayer shown in FIG. 7.

To the reinforcing member 515, a single vertical rib or a block-like convex face portion can be applied, but it is preferable to arrange a plurality of thin vertical ribs with an interval on the front of the body portion 52*b* as shown in FIG. 8, considering moldability.

In the trigger-type liquid sprayer configured as above with the reinforcing member 515 arranged, even if it is dropped or given an impact with the sprayer downward, a large force is not applied to the boundary portion between the sprayer and the cap 55, and that portion, particularly the intake 53 (base portion 53*b*, flange 53$b_1$) or the cap 55 is not easily damaged and the intake 53 is difficult to be removed from the body 52.

The body 54 may be provided with the cover 54 that accommodates at least a part of the spray nozzle. In a structure in which the cover 54 is constructed by a separate body and the cover 54 is assembled into the body 52 as shown in FIG. 7, a convex face portion 54' forming an extremely small gap at the opening end edge 55' of the cap 55 may be also provided at the cover 54, and by surrounding the boundary portion between the sprayer and the cap 55 by the reinforcing member 515 and the convex face portion 54', damage at the boundary portion can be surely avoided.

The reinforcing member 515 and the convex face portion 54' may have dimensions covering the entire region up to the opening end edge 55' of the cap 55, but an extremely small gap is formed considering a molding error or assembling error.

According to the present invention, by providing the reinforcing member between the lower end of the body portion constituting the body and the opening end edge of the cap, even if an impact force is applied to the liquid sprayer, the impact force is absorbed/relaxed by the reinforcing member, by which damage at the intake or the boundary portion between the liquid sprayer and the cap is avoided.

Thus, the trigger-type liquid sprayer which is not easily damaged even by an inadvertent impact such as erroneous drop can be provided.

With the liquid sprayer of the present invention, a liquid to be sprayed is not particularly limited but the liquid sprayer is suitably used for spraying detergent for a house and mildew cleaner, and is suitably used for spraying a liquid containing sodium hypochlorite, particularly sodium hypochlorite and surfactant. It is also used for spraying of a liquid containing a hydrogen peroxide solution, particularly a hydrogen peroxide solution and surfactant.

The present invention is not limited by the above embodiments.

In the liquid sprayer of the present invention, it is preferable that the nozzle 21 is positioned only by abutment between the rod portion 244 in the operation lever 24 and the abutment portion 31 in the shroud 3 as in the liquid sprayer 1 in the embodiment, but since a rotary torque of the operation lever can be reduced by this abutment, such a construction may be used at the same time that an engagement projection portion is provided at a conventional nozzle and spin element for positioning of the nozzle. Positioning may be also carried out by providing a locking recess portion at the shroud 3 and locking the rod portion on the locking recess portion.

In the liquid sprayer of the present invention, it is preferable that the operation lever 24 also functions as a stopper prohibiting the pulling operation of the trigger lever 22 as in the embodiment, but it does not have to function as the stopper.

In the above embodiment, a contact point between the recess portion on the back side of the trigger lever and the projection portion at the tip end of the piston is made as a point of application between the trigger lever and the piston, but on the contrary, the projection portion may be provided on the back side of the trigger lever and the recess portion at the tip end of the piston.

In the liquid sprayer of the present invention, it is preferable that the nozzle is provided rotatable around an axis of the spray hole and the grooves are made to communicate with each other according to a rotational position when the operation lever mounted on the nozzle is rotated so as to form a flow passage for a liquid as in the embodiment, but the invention may be also applied to a liquid sprayer in which the nozzle is not rotated.

The present invention provides a trigger-type liquid sprayer which can restrict damage of a part associated with positioning of a nozzle and moreover enables easy checking of the nozzle position.

The present invention provides a trigger-type liquid sprayer which is capable of size reduction and is easily handled.

The present invention provides a trigger-type liquid sprayer which can restrict damage on a fitting portion between a nozzle and a spin element and can spray a liquid stably.

What is claimed is:

1. A trigger-type liquid sprayer comprising:

a liquid sprayer body including a nozzle and a trigger lever and a shroud covering the liquid sprayer body in which a liquid is sprayed from a spray hole of the nozzle by a pulling operation of the trigger lever, the nozzle being rotatable with respect to the liquid sprayer body and provided so that a flow passage of the liquid is opened and closed according to a rotational position of the nozzle when an operation lever mounted on the nozzle is rotationally moved between opened and closed positions, respectively;

an abutment portion being provided at the shroud for positioning the nozzle at a position where the flow passage is opened by having the operation lever abutted to the abutment portion in the opened position;

a first cylindrical portion including a first groove; and a second cylindrical portion that is radially offset with respect to the first cylindrical portion, the second cylindrical portion including a second groove, and the second cylindrical portion being configured to rotate with respect to the first cylindrical portion i) so as to radially align the second groove with the first groove to open the flow passage, and ii) so as to radially misalign the second groove with respect to the first groove to close the flow passage, wherein the trigger lever travels along an actuation path in a pull direction and an opposing release direction, the pull direction corresponding to a direction of the pulling operation on the trigger lever;

the operation lever includes a rod that is fixed to the nozzle, a knob that is fixed to the rod, and a projection that is fixed to the knob, such that, when the flow passage is closed by the nozzle through rotational movement of the operation lever to the closed position, the rod is provided to be accommodated in front of the trigger lever, so that the trigger lever is inhibited from extending further along the actuation path in the release direction, the knob is provided so as to extend, in the pull and release directions, across a side of the trigger lever, and the projection is provided as to extend behind the trigger lever to inhibit the trigger lever from extending further along the actuation path of the trigger lever in the pull direction;

the trigger lever includes a space provided by a recess in a front face portion of the trigger lever on a side of the trigger lever including a rotation center, the recess being a stepped portion;

the stepped portion includes a reinforcing rib that extends between a base surface of the stepped portion and a depth surface rising from the base surface, the base surface extending in the pull and release directions, and the depth surface and the reinforcing rib extending vertically from the base surface; and when the operation lever is in the closed position, the reinforcing rib functions as a stopper for the operation lever by contacting the rod of the operation lever.

2. The trigger-type liquid sprayer according to claim 1, wherein:

the first cylindrical portion is a portion of a spin element and is fitted in the second cylindrical portion, which extends in a direction opposite to the spraying direction of the nozzle; and the positioning of the nozzle is carried out only by abutment between the operation lever and the abutment portion.

3. The trigger-type liquid sprayer according to claim 1 used for spraying of a liquid containing sodium hypochlorite.

4. The trigger-type liquid sprayer according to claim 1, wherein:

a surface of the trigger lever facing the release direction, which forms a contact area for the pulling operation of the trigger lever, includes the recess that forms a space along the actuation path in front of the trigger lever at an end of the trigger lever that is proximate to the nozzle; and when the flow passage is closed by the nozzle through rotational movement of the operation lever to the closed position, the rod of the operation lever is provided to be accommodated in the space, in front of the trigger lever, so that the trigger lever is inhibited from extending further along the actuation path in the release direction.

5. The trigger-type liquid sprayer according to claim 1, wherein, when the operation lever is in the closed position, the trigger lever extends, in a direction away from the nozzle, beyond the knob.

6. The trigger-type liquid sprayer according to claim 1, wherein, when the operation lever is in the closed position, the rod extends from the nozzle at an angle so as to extend from a center area of a front surface of the trigger lever to a side area of the front surface, where the rod is fixed to the knob, the knob having a planar shape that extends along the side of the trigger lever, in the pull and release directions, to respective points beyond rear and front surfaces of the trigger lever.

7. The trigger-type liquid sprayer according to claim 1, wherein, when the operation lever is in the closed position, the projection fills a space between a rear surface of the trigger lever and a portion of the liquid sprayer body.

* * * * *